US006887127B2

(12) United States Patent
Nishikawa et al.

(10) Patent No.: US 6,887,127 B2
(45) Date of Patent: May 3, 2005

(54) POLISHING APPARATUS

(75) Inventors: Toru Nishikawa, Nagaokakyo (JP); Takeshi Inao, Nagaokakyo (JP)

(73) Assignee: Murata Manufacturing Co., Ltd., Nagaokakyo (JP)

( * ) Notice: Subject to any disclaimer, the term of this patent is extended or adjusted under 35 U.S.C. 154(b) by 76 days.

(21) Appl. No.: 10/108,417

(22) Filed: Mar. 29, 2002

(65) Prior Publication Data

US 2002/0142703 A1 Oct. 3, 2002

(30) Foreign Application Priority Data

Apr. 2, 2001 (JP) ..... 2001-102894

(51) Int. Cl.[7] ..... B24B 49/00

(52) U.S. Cl. ..... 451/6; 451/9; 451/11; 451/261; 451/269

(58) Field of Search ..... 41/264; 451/267, 451/268, 269, 5, 6, 8, 9, 10, 11, 132, 134, 135, 146, 194, 210, 261, 262, 264

(56) References Cited

U.S. PATENT DOCUMENTS 4,433,510 A * 2/1984 Katagiri et al. ..... 451/5
4,524,547 A * 6/1985 Heaston et al. ..... 451/5
5,088,239 A * 2/1992 Osman ..... 451/5
5,969,521 A * 10/1999 Kurita et al. ..... 324/229

FOREIGN PATENT DOCUMENTS

JP 11-77521 3/1999

* cited by examiner

*Primary Examiner*—Hadi Shakeri
(74) *Attorney, Agent, or Firm*—Burns, Doane, Swecker & Mathis, L.L.P.

(57) ABSTRACT

A polishing apparatus is provided for accurately detecting the relative displacement between an upper wheel and a lower wheel and thus for reliably polishing workpieces to a desired thickness. The polishing apparatus includes an upper wheel for pressing at least one workpiece, a lower wheel for supporting the workpiece, non-contact-type displacement-detection device for detecting the relative displacement between the upper wheel and the lower wheel, and a reference table for providing a displacement-detection reference position. The non-contact-type displacement-detection device is joined to the upper wheel so as to move therewith. The reference table is disposed at a position opposing the displacement-detection device and also is integrally connected to the lower wheel.

6 Claims, 5 Drawing Sheets

POLISHING APPARATUS

BACKGROUND OF THE INVENTION

1. Field of the Invention

The present invention relates to polishing apparatuses, and more particularly to a polishing apparatus for accurately measuring the amount of a workpiece which is polished.

2. Description of the Related Art

A known polishing apparatus for polishing a metal, a ceramic, and a semiconductor material has a configuration as shown in FIG. 6.

The polishing apparatus is for polishing the upper and lower surfaces of workpieces W at the same time, and comprises an upper wheel 1 for pressing the workpieces W and a lower wheel 2 for supporting the workpieces W. The upper wheel 1 and the lower wheel 2 are coaxially arranged with each other. A plurality of carries 3, which performs a sun-and-planet rotation while holding the workpieces W, is arranged along the circumferential direction of the upper wheel 1 and the lower wheel 2 and between these two wheels.

The upper wheel 1 is vertically moved by an air cylinder 7 attached to a stationary support member 6. The upper wheel 1 has a substantially spherical holder 1*a*, formed in the upper middle thereof, for holding a spherical pressure head 8 which is disposed at the bottom of the air cylinder 7.

The pressure head 8 has an electrical micrometer 10 attached thereto as a displacement-detection means for detecting the relative displacement between the upper wheel 1 and the lower wheel 2. The electrical micrometer 10 has a main unit 10*a* which is fixed to the pressure head 8 and a probe 10*b* which serves as a displacement-detection rod and which is expandable with respect to the main unit 10*a*.

The lower wheel 2 has a short cylindrical shape and has a substantially cylindrical wheel drive shaft 12 coaxially fixed thereto. In addition, the lower wheel 2 is rotatably supported by a bearing 13 and has gear teeth 12*a* which are formed around the outer periphery of the bottom portion of the lower wheel 2. The gear teeth 12*a* engage with a gear 14 which is directly connected to a wheel drive motor 15.

The wheel drive shaft 12 has a carrier drive shaft 18, coaxially arranged therein and supported by a bearing 19, for rotating and revolving the carriers 3. The carrier drive shaft 18 has gear teeth 18*a* which are formed around the outer rim periphery of the bottom thereof and which engage with a gear 20 directly connected to a first carrier drive motor 21. The upper part of the carrier drive shaft 18 is enlarged in diameter to form a diameter-enlarged portion 18*b*. The diameter-enlarged portion 18*b* has a reference table 22. The reference table 22 is formed at the center of the upper surface of the diameter enlarged portion 18*b* in a projecting manner so as to be integral therewith, and against which the probe 10*b* of the electrical micrometer 10 abuts. The diameter-enlarged portion 18*b* also has a large number of inner pins 23 which are formed along the outer rim of the upper surface thereof and which engage with a gear-like toothed portion 3*a* formed along the outer rim of each of the carriers 3.

Outside the lower wheel 2 and the wheel drive shaft 12 fixed thereto, an outer ring 25 supported by a bearing 26 is arranged in a manner coaxial with the lower wheel 2 and the wheel drive shaft 12 so as to rotate and revolve the carriers 3 around the same. The outer ring 25 has gear teeth 25*a* which are formed around the outer periphery of the bottom portion thereof and which engage with a gear 27 directly connected to a second carrier drive motor 28. The outer ring 25 also has a large number of outer pins 29 which are arranged along an inner rim of the upper surface thereof and which engage with the toothed portion 3*a*.

The inner pins 23 and the outer pins 29 function as a sun gear and an inner gear, respectively, so that the first carrier drive motor 21 and the second carrier drive motor 28 rotate synchronously with each other.

When the known polishing apparatus having the foregoing configuration polishes the Workpieces W, the carriers 3 holding the workpieces W are arranged on the lower wheel 2, and the toothed portion 3*a* formed around the outer rim of the carrier 3 are arranged to engage with the inner and outer pins 23 and 29. Subsequently, the air cylinder 7 is activated for the pressure head 8 to press the upper wheel 1. Thus the workpieces W are sandwiched and pressed between the upper wheel 1 and the lower wheel 2.

In this state, while an abrasive slurry is interposed between the upper wheel 1 and the workpieces W and between the lower wheel 2 and the workpieces W, the wheel drive motor 15 is activated for rotation, and also the first carrier drive motor 21 and the second carrier drive motor 28 are activated for synchronous rotation. Then, the wheel drive shaft 12 and the lower wheel 2 are driven for rotation by the wheel drive motor 15. Also, the carrier drive shaft 18 and the inner pins 23 fixed thereto are driven for rotation by the first carrier drive motor 21, and the outer ring 25 and the outer pins 29 fixed thereto are driven for rotation by the second carrier drive motor 28.

Thus, the inner pins 23 and the outer pins 29, both engaging with the toothed portion 3*a* formed along the outer rim of the carrier 3, allow the carrier 3 holding the workpiece W to rotate and revolve around the upper and lower wheels 1 and 2 in the circumferential direction thereof. Thus, the carrier 3 performs a sun-and-planet motion, allowing both the upper and lower surfaces of the workpiece W to be polished by utilizing a relative difference in speeds between the upper wheel 1 and the upper surface of the workpiece W and between the lower wheel 2 and the lower surface of the workpiece W.

Polishing the upper and lower surfaces of each of the workpieces W leads to displacement of the upper wheel 1, resulting in a gradual reduction in the distance between the upper wheel 1 and the lower wheel 2. Thus, when the amount of expansion and contraction of the probe 10*b* abutting against the reference table 22 changes, the main unit 10*a* of the electrical micrometer 10 outputs detection signals in accordance with the change in expansion and contraction. Then, a controller (not shown) determines whether or not the thickness of the workpieces W agrees with a predetermined target value on the basis of the detection output from the electrical micrometer 10. When the thickness of the workpieces W reaches the target value, the motors 15, 21, and 28 are stopped thus completing the polishing of the workpieces W.

In the known polishing apparatus, the reference table 22 is fixed at the top of the carrier drive shaft 18, and the carrier drive shaft 18 is configured separately from the lower wheel 2 by the bearing 19. With this arrangement, a shaky motion of the bearing 19 or the carrier drive shaft 18 in the axial direction thereof prevents a change in expansion and contraction of the probe 10*b* from accurately following the relative displacement between the upper wheel 1 and the lower wheel 2, thereby causing a detection error of the amount of polishing of the workpieces W.

That is to say, detection of the relative displacement between the lower surface of the upper wheel 1 and the upper surface of the lower wheel 2 is required in order to measure an accurate amount of polishing of the workpieces W. Since the carrier drive shaft 18, to which the lower wheel 2 is fixed, is configured separately from the lower wheel 2, a slight shift of the carrier drive shaft 18 along the axial direction thereof caused by, e.g., a shaky motion of the bearing 19 and the like leads, to a change in expansion and contraction of the probe 10*b*. As a result, the change in expansion and contraction of the probe 10*b* does not accurately follow the relative displacement between the upper wheel 1 and the lower wheel 2, thereby giving rise to an error in detecting the relative displacement.

SUMMARY OF THE INVENTION

In view of the above problem, it is an object of the present invention to provide a polishing apparatus for accurately detecting the relative displacement between an upper wheel and a lower wheel so that workpieces are reliably polished to a desired thickness.

To achieve the above object, a polishing apparatus according to the present invention comprises the following elements: an upper wheel for pressing at least one workpiece to be polished; a lower wheel for supporting the workpiece; displacement-detection means, joined to the upper wheel to move together therewith, for detecting the relative displacement between the upper wheel and the lower wheel; and a reference table, arranged at a position opposing the displacement-detection means and connected to the lower wheel, for providing a displacement-detection reference position. Thus, the workpiece is polished by a relative difference in speeds between the workpiece and at least one of the lower wheel and the upper wheel.

With this configuration, the reference table is integrally connected to the lower wheel, thereby accurately providing a displacement-detection reference position. Accordingly, the relative displacement between the upper wheel and the lower wheel can be detected directly and accurately, thus allowing the workpieces to be polished reliably to a desired thickness.

The polishing apparatus may further comprise the following elements: a substantially cylindrical wheel drive shaft coaxially fixed to the lower wheel having a cylindrical shape; at least one carrier for holding the workpiece; a carrier drive shaft, coaxially arranged in the wheel drive shaft, for driving the carrier for rotation and revolution around the lower wheel; a transmission shaft connected to the carrier drive shaft for driving the carrier drive shaft; and a connection arm passing through a through-hole formed in the carrier drive shaft. The lower wheel and the reference table are joined together through the connection arm, and the transmission shaft is rotatably mounted on the inner wall of the wheel drive shaft.

With this configuration, when the wheel drive shaft and the carrier drive shaft are each driven for rotation, the relative positional relationship between the connection arm, connecting the reference table and the lower wheel, and the transmission shaft driving the carrier drive shaft remains unchanged. Accordingly the connection arm and the transmission shaft do not interfere with each other. As a result, each of the wheel drive shaft and the carrier drive shaft can rotate smoothly and independently from each other.

In the polishing apparatus, the transmission shaft is preferably a flexible shaft.

With this simple configuration, the transmission shaft allows a motor to drive the carrier drive shaft for rotation.

In the polishing apparatus, the displacement-detection means is preferably of a contact-type comprising a probe which abuts against the reference table.

With this relatively simple configuration, the relative displacement between the upper wheel and the lower wheel can be detected.

In the polishing apparatus, the displacement-detection means is preferably of a non-contact-type comprising a light emitting and receiving unit for emitting light to and receiving light from the reference table, respectively.

This configuration eliminates error factors such as a vibration, thus allowing the relative displacement between the upper wheel and the lower wheel to be detected more accurately.

DESCRIPTION OF THE PREFERRED EMBODIMENT

Referring to the accompanying drawings, embodiments of the present invention will be described in detail.

First Embodiment

Figure 1:
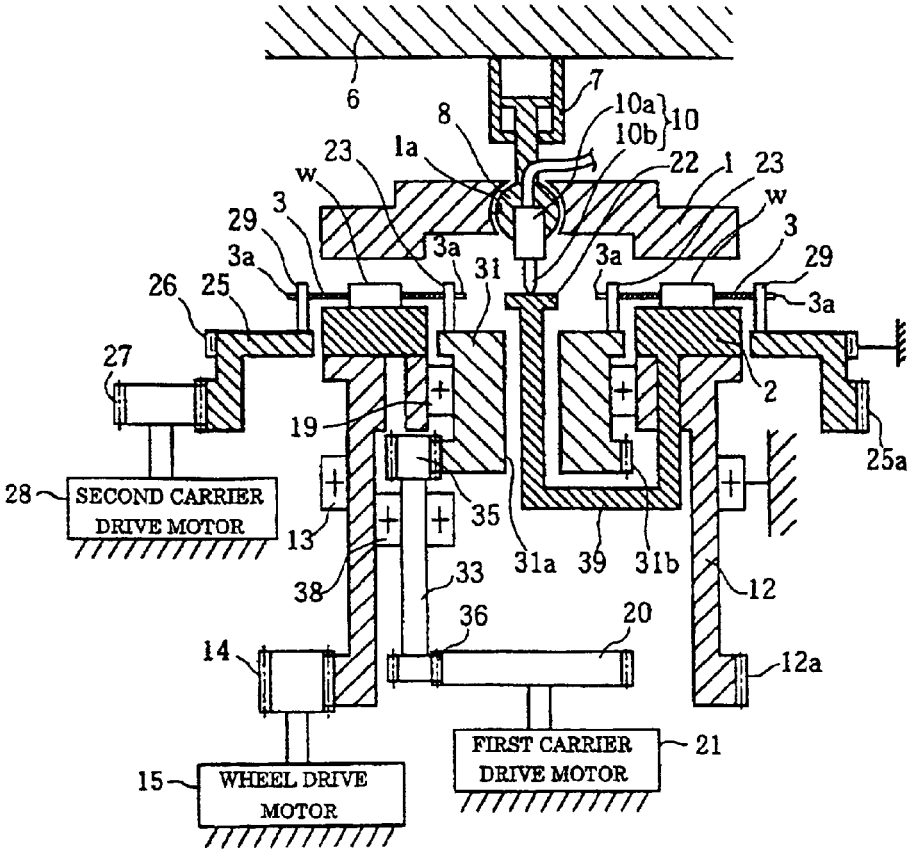
FIG. 1 is a sectional view of a polishing apparatus according to a first embodiment of the present invention.
Figure 2:
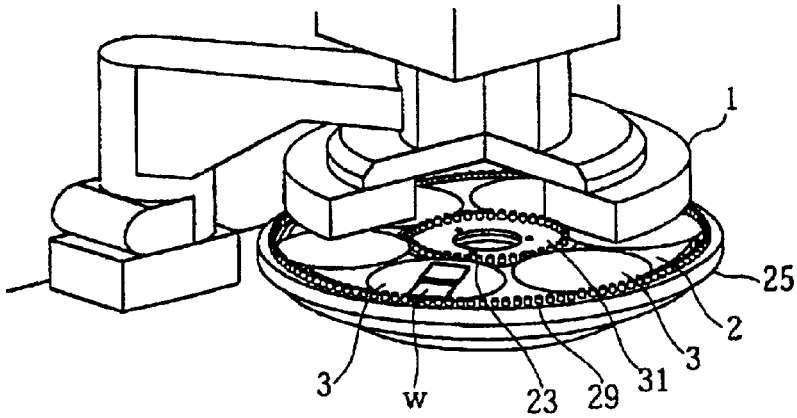
FIG. 2 is a perspective view of the polishing apparatus of the first embodiment.
Figure 6:
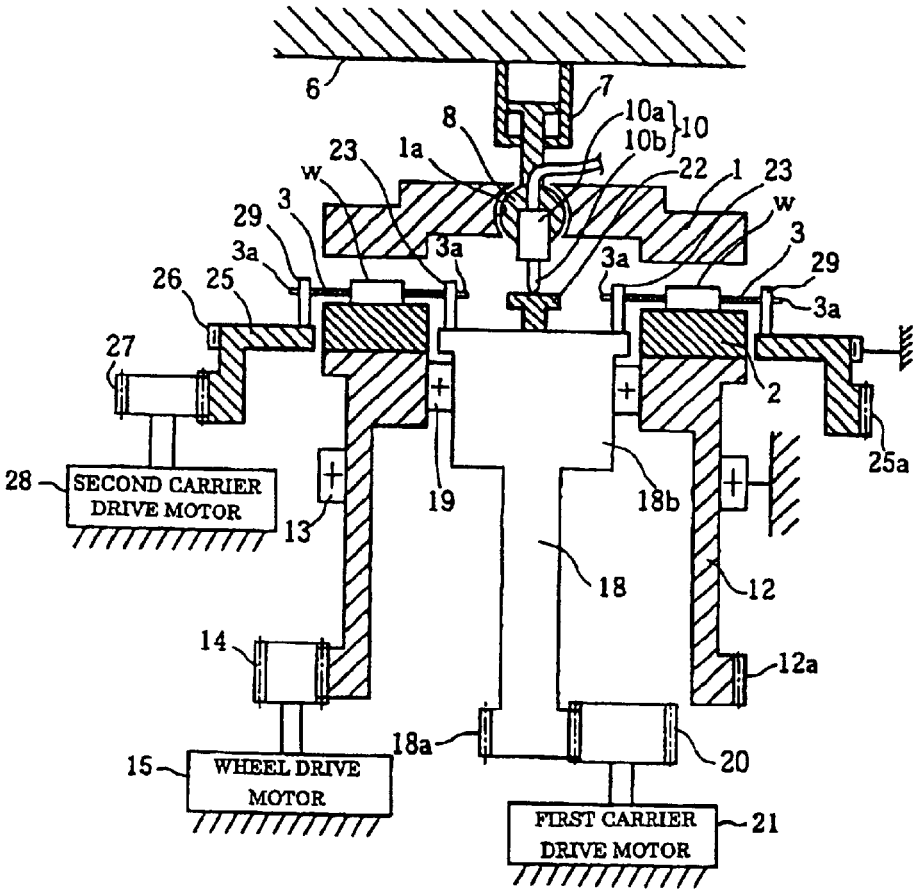
FIG. 6 PRIOR ART
FIG. 6 is a sectional view of a known polishing apparatus.

FIGS. 1 and 2 are a sectional view and a perspective view, respectively, of a polishing apparatus according to a first embodiment of the present invention. Like parts are identified by the same reference numerals as in the related art shown in FIG. 6.

The polishing apparatus of the first embodiment polishes the upper and lower surfaces at the same time of a workpiece to be polished W. The polishing apparatus comprises an upper wheel 1 for pressing the workpiece W and a lower wheel 2 for supporting the workpiece. These wheels are arranged coaxially with each other. Additionally, a plurality of carries 3, which performs sun-and-planet rotation while holding the workpieces, is arranged between the upper wheel 1 and the lower wheel 2 in the circumferential direction thereof.

The upper wheel 1 is moved vertically by an air cylinder 7 which is attached to a stationary support member 6. The upper level 1 has a substantially spherical holder 1*a*, formed in the middle thereof, for holding a spherical pressure head 8 which is disposed at the bottom of the air cylinder 7.

The pressure head 8 has an electrical micrometer 10 attached thereto as a contact-type displacement-detection means for detecting the relative displacement between the upper wheel 1 and the lower wheel 2. The electrical micrometer 10 has a main unit 10*a* which is fixed to the pressure head 8 and a probe 10*b* which serves as a displacement-detection rod and which is expandable with respect to the main unit 10*a*.

The lower wheel 2 has a short cylindrical shape and has a substantially cylindrical wheel drive shaft 12 which is coaxially fixed thereto. In addition, the lower wheel 2 is rotatably supported by a bearing 13 and has gear teeth 12*a* formed around the outer periphery of the bottom portion of the lower wheel 2. The gear teeth 12*a* engage with a gear 14 which is directly connected to a wheel drive motor 15.

The wheel drive shaft 12 has a substantially cylindrical carrier drive shaft 31, coaxially arranged therein and supported by a bearing 19, for rotating and revolving the carriers 3. The carrier drive shaft 31 has a through-hole 31*a* formed in the middle thereof along the rotation axis thereof. Gear teeth 31*b* are formed around the outer periphery of the bottom portion thereof. The gear teeth 31*b* engage with a gear 35 which is fixed to the top of a transmission shaft 33. The transmission shaft 33 has a gear 36 fixed to the bottom of the carrier drive shaft 31. The gear 36 engages with a gear 20 which is directly connected to a first carrier drive motor 21. The transmission shaft 33 is rotatably mounted on the inner wall of the wheel drive shaft 12 and supported by a bearing 38.

The carrier drive shaft 31 has a large number of inner pins 23 arranged along the outer rim of the upper surface thereof. The inner pins 23 engage with a gear-like toothed portion 3*a* formed around the outer periphery of each of the carriers 3.

The electrical micrometer 10 has a reference table 22 arranged at a position opposed thereto for offering a displacement-detection reference. The end of the probe 10*b* abuts against the flat upper surface of the reference table 22. The reference table 22 and the lower wheel 2 are joined together by a U-shaped connection arm 39. More particularly, the connection arm 39 is in communication with the lower wheel 2 at one end thereof while vertically passing through a portion of the wheel drive shaft 12 and has the reference table 22 at the other end thereof while passing through the through-hole 31*a* upwardly from the bottom of the carrier drive shaft 31 in a manner coaxial with the carrier drive shaft 31.

An outer ring 25, supported by a bearing 26, is arranged in a manner coaxial with and outside the lower wheel 2 and the wheel drive shaft 12 so as to rotate and revolve the carriers 3 around the same. The outer ring 25 has gear teeth 25*a* which are formed around the outer periphery of the bottom portion thereof and which engage with a gear 27 which is directly connected to a second carrier drive motor 28. The outer ring 25 also has a large number of outer pins 29 which are arranged along an inner rim of the upper surface thereof and which engage with the toothed portion 3*a*.

The inner pins 23 and the outer pins 29 function as a sun gear and an inner gear, respectively, so that the first carrier drive motor 21 and the second carrier drive motor 28 rotate synchronously with each other.

Next, an operation of the polishing apparatus having the above configuration for polishing the workpiece W will be described.

The carriers 3, holding the workpieces W, are arranged on the lower wheel 2, and the toothed portion 3*a* formed around the outer rim of the carrier 3 are arranged to engage with the inner and outer pins 23 and 29. Subsequently, the air cylinder 7 is activated for the pressure head 8 to press the upper wheel 1 vertically, and thus the workpieces W are sandwiched and pressed between the upper wheel 1 and the lower wheel 2.

In this state, while an abrasive slurry is interposed between the upper wheel 1 and the workpieces W and between the lower wheel 2 and the workpieces W, the wheel drive motor 15 is activated for rotation. Also the first carrier drive motor 21 and the second carrier drive motor 28 are activated for synchronous rotation. Then, the wheel drive shaft 12 and the lower wheel 2 are driven for rotation by the wheel drive motor 15. Also, the carrier drive shaft 31 and the inner pins 23 fixed thereto are driven for rotation by a drive force of the first carrier drive motor 21 transmitted through the transmission shaft 33. Furthermore, the outer ring 25 and the outer pins 29 fixed thereto are driven for rotation by the second carrier drive motor 28.

Thus, the inner pins 23 and the outer pins 29, both engaging with the toothed portion 3*a* formed along the outer rim of the carrier 3, allow the carrier 3 holding the workpiece W to rotate and revolve around the upper and lower wheels 1 and 2 in the circumferential direction thereof. Thus, the carrier 3 performs a sun-and-planet motion, allowing both the upper and lower surfaces of the workpiece W to be polished by utilizing a relative difference in speeds between the upper wheel 1 and the upper surface of the workpiece W and between the lower wheel 2 and the lower surface of the workpiece W.

While the wheel drive shaft 12 and the carrier drive shaft 31 are rotating, the relative positional relationship between the transmission shaft 33 and the connection arm 39 connecting the reference table 22 and the lower wheel 2 is unchanged, since the transmission shaft 33 is rotatably mounted on the inner wall of the wheel drive shaft 12 supported by the bearing 38. This allows the wheel drive shaft 12 and the carrier drive shaft 31 to rotate independently and smoothly without mutual interference of the connection arm 39 and the transmission shaft 33.

As described above, polishing the upper and lower surfaces of each of the workpieces W leads to downward displacement of the upper wheel 1, thus resulting in a gradual reduction in the distance between the upper wheel 1 and the lower wheel 2. In this case, the relative positional relationship, between the upper surfaces of the reference table 22 and the lower wheel 2, is unchanged since the reference table 22 is integrally connected to the lower wheel 2, by the connection arm 39. In addition, since the end of the probe 10*b* of the electrical micrometer 10 abuts against the upper surface of the reference table 22, the relative displacement between the upper wheel 1 and the lower wheel 2 directly causes a change in expansion and contraction of the probe 10*b*. Accordingly, this eliminates known problems such as disruptions caused by a vertical displacement of the lower wheel 2 and by swinging of the bearing 19 holding the carrier drive shaft 31.

Thus, when the amount of expansion and contraction of the probe 10*b* abutting against the reference table 22 changes, the main unit 10*a* of the electrical micrometer 10 outputs detection signals in accordance with the change in expansion and contraction. Then, a controller (not shown) determines whether or not the thickness of the workpieces W agrees with a predetermined target value based on the detection output from the electrical micrometer 10. When the thickness of the workpieces W reaches the target value, the motors 15, 21, and 28 are stopped to complete the polishing of the workpieces W.

In the first embodiment as described above, since the connection arm 39 integrally connects the reference table 22 and the lower wheel 2, the reference table 22 accurately offers a displacement-detection reference position, thus allowing a change in a relative distance between the upper wheel 1 and the lower wheel 2 to be detected directly and accurately. Thus, the workpieces W can be polished so as to reliably have a desired thickness.

Second Embodiment

Figure 3:
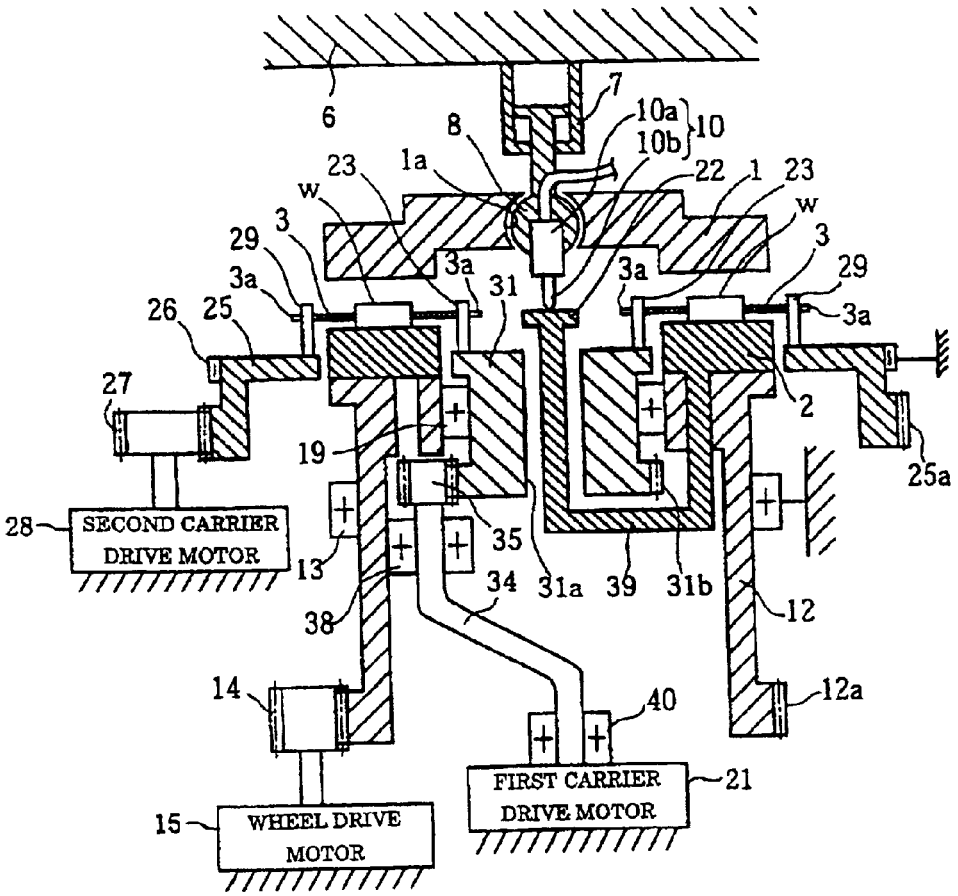
FIG. 3 is a sectional view of a polishing apparatus according to a second embodiment of the present invention.

FIG. 3 is a sectional view of a polishing apparatus according to a second embodiment of the present invention.

Like parts are identified by the same reference numerals as in the first embodiment shown in FIG. 1.

Though the transmission shaft 33 in the first embodiment is connected to the first carrier drive motor 21 through the gears 20 and 36, a flexible shaft 34 is used in the second embodiment as a transmission shaft. This configuration eliminates the gears 20 and 36 used in the first embodiment, and instead the flexible shaft 34 is rotatably supported by the bearing 38 at one end and by a bearing 40 at the other end thereof.

Since the configuration of the second embodiment is basically the same as that of the first embodiment, detailed descriptions thereof will be omitted.

In the second embodiment, the flexible shaft 34 having a simple structure eliminates the gears 20 and 36 used in the first embodiment, making it possible to transmit a power of the first carrier drive motor 21 to the carrier drive shaft 31.

Third Embodiment

Figure 4:
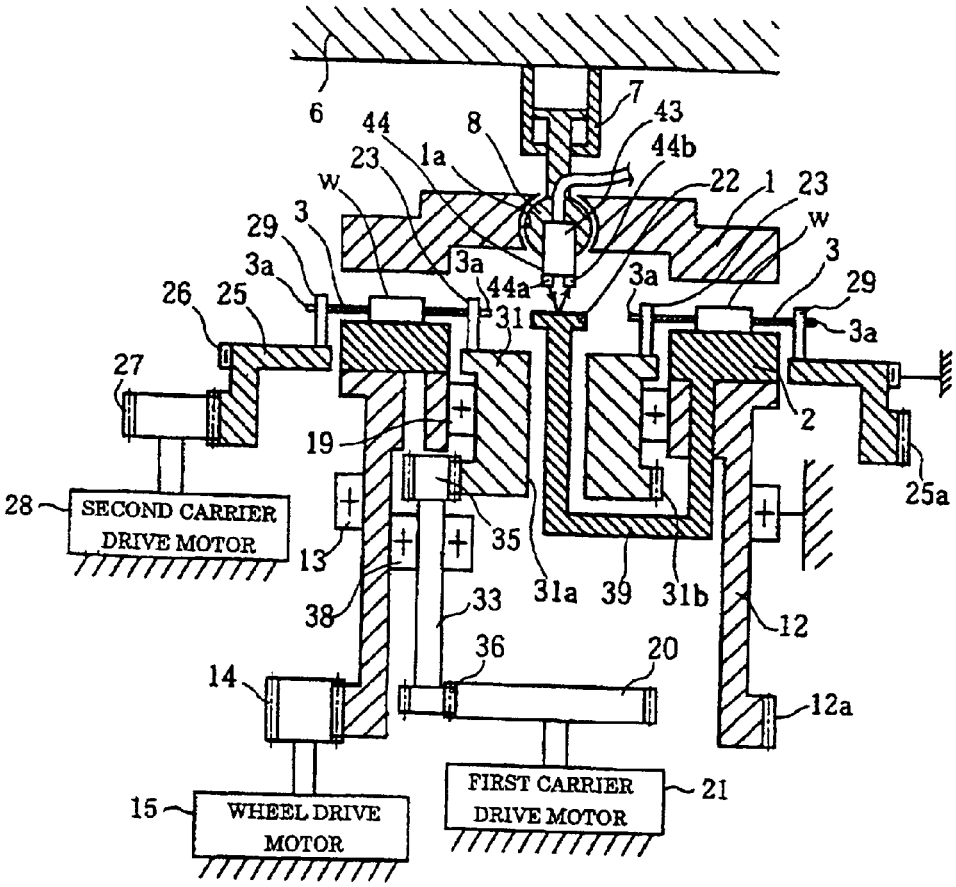
FIG. 4 is a sectional view of a polishing apparatus according to a third embodiment of the present invention.

FIG. 4 is a sectional view of a polishing apparatus according to a third embodiment of the present invention, wherein like parts are identified by the same reference numerals as in the first embodiment shown in FIG. 1.

Although the contact-type electrical micrometer 10 is used as displacement-detection means in the first embodiment, a non-contact-type displacement-detection means 43 is used in the third embodiment. The displacement-detection means 43 has a light emitting and receiving unit 44 provided with a light emitting element 44*a* and a photo detecting element 44*b*. Since the light emitting and receiving unit 44 is fixed to the pressure head 8, the light emitting and receiving unit 44 is joined with the upper wheel 1 so as to vertically move together.

Since the configuration of the third embodiment is basically the same as that of the first embodiment, detailed descriptions thereof will be omitted.

Since the electrical micrometer 10 used in the first embodiment is contact-type displacement-detection means, it is likely that a swinging motion of the bearing 13 and the like, caused by the rotating wheel drive shaft 12 is directly transmitted to the probe 10*b*. Alternatively, a detection error is caused by, for example, an imperfect alignment of the probe 10*b* and the reference table 22. In the third embodiment, since light emitted from the light emitting element 44*a* of the light emitting and receiving unit 44 illuminates the surface of the reference table 22 and the reflected light is received by the photo detecting element 44*b*, the relative displacement between the upper wheel 1 and the lower wheel 2 can be detected in a non-contact manner, thereby eliminating an error factor caused by vibration and the like. Thus allows the relative displacement between the upper wheel 1 and the lower wheel 2 to be detected more accurately.

Fourth Embodiment

Figure 5:
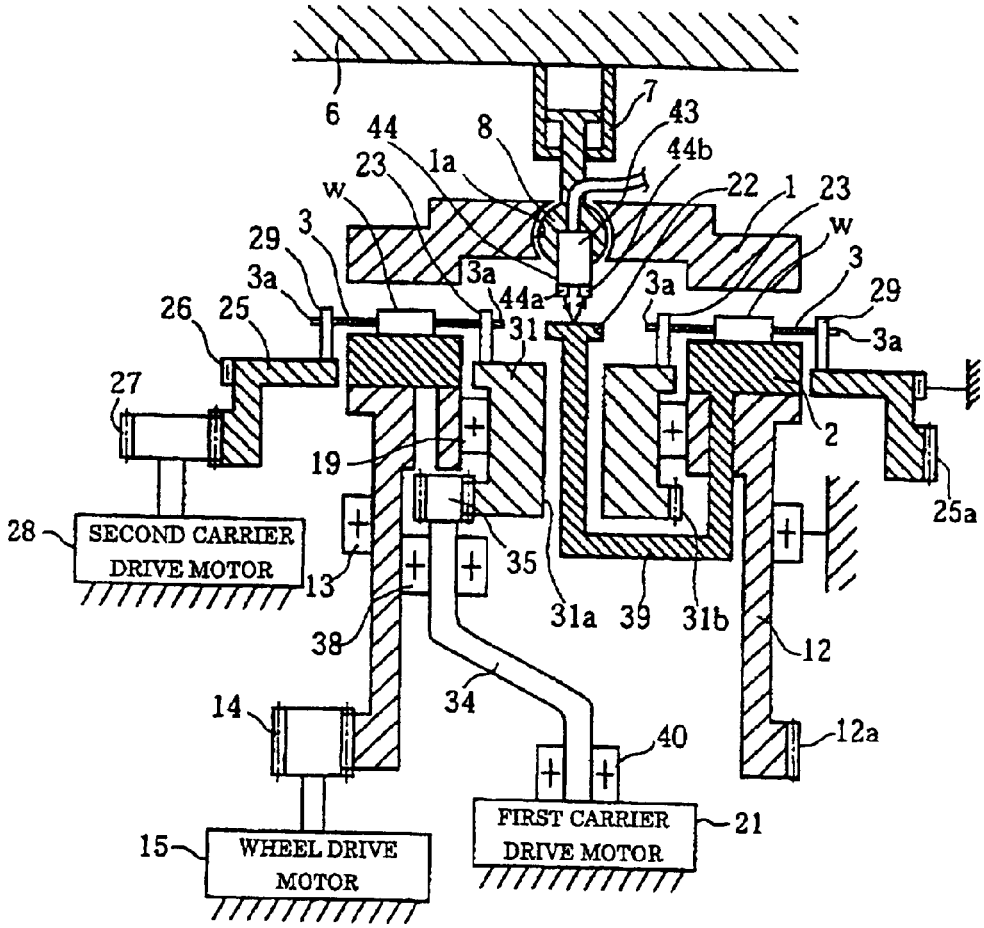
FIG. 5 is a sectional view of a polishing apparatus according to a fourth embodiment of the present invention.

FIG. 5 is a sectional view of a polishing apparatus according to a fourth embodiment of the present invention, wherein like parts are identified by the same reference numerals as in the second embodiment shown in FIG. 3.

Although the contact-type electrical micrometer 10 is used as displacement-detection means in the second embodiment, the non-contact-type displacement-detection means 43 is used in the fourth embodiment in the same fashion as in the third embodiment, wherein the displacement-detection means 43 has the light emitting and receiving unit 44 provided with the light emitting element 44*a* and the photo detecting element 44*b*.

Since the configuration of the fourth embodiment is basically the same as that of the second embodiment, detailed descriptions thereof will be omitted.

In the fourth embodiment, the relative displacement between the upper wheel 1 and the lower wheel 2 can be also detected in a non-contact manner, thereby eliminating an error factor caused by vibration and the like, and thus allowing the relative displacement between the upper wheel 1 and the lower wheel 2 to be detected more accurately.

In the first to fourth embodiments, rotational speeds and directions of rotation of the upper wheel 1, the lower wheel 2, and the carriers 3 are not limited, and can be set freely as long as the workpieces W are polished.

In the first to fourth embodiments, the carriers 3 are driven for rotation by the inner pins 23 and the outer pins 29. However, instead of the pins 23 and 29, gear teeth may be formed along the outer rim of the carrier drive shaft 31 and also along the inner rim of the outer ring 25 so as to function as a sun gear and an inner gear, respectively, and thus the carrier 3 is configured as a planet gear.

Although the polishing apparatuses according to the first to fourth embodiments are configured to polish the upper and lower surfaces of the workpieces W at the same time, the present invention is not limited to this configuration. For example, the present invention is applicable to a configuration in which the carrier drive shaft 31 and the outer ring 25 are excluded, the workpieces W are fixed to the upper wheel 1, and the lower wheel 2 is driven for rotation by the wheel drive shaft 12 so as to polish only the lower surface of the workpieces W. The present invention is also applicable to another configuration in which rotating only the carries 3 by the carrier drive shaft 31 and the outer ring 25 allows the workpieces W to be polished while the upper wheel 1 and the lower wheel 2 are held stationary.

Basically, the present invention is broadly applicable to a polishing apparatus as long as the polishing apparatus has a configuration in which, the workpieces W are polished by utilizing a relative difference in speeds between the workpieces W and at least the lower wheel 2, while the workpieces W are pressed by the upper wheel 1.

In the third and forth embodiments, the non-contact-type displacement-detection means 43 employs the light for displacement detection. However, instead of the light for displacement detection, an eddy current or an electrostatic capacity may be employed for displacement detection.

A error range of the displacement-detection signal caused by a surface shape (coarseness) of the reference table 22 by means of the eddy current or the electrostatic capacity is smaller than that of the displacement-detection signal by means of the light.

In addition, when the reference table is consisted by a conductive material (for example, a metal) and the eddy current is employed for displacement detection, even if non-metal material such as an abrasive powder or an abrasive liquid remains between the reference table and the non-contact-type displacement-detection means 43 or on there, the error range of the displacement-detection signal becomes lower than that of the displacement-detection by means of the light, the electrostatic capacity or others.

What is claimed is:

1. A polishing apparatus, comprising:

an upper wheel for pressing at least one workpiece to be polished;

a lower wheel for supporting the at least one workpiece;

displacement-detection means, joined to the upper wheel to move together therewith, for detecting relative displacement between the upper wheel and the lower wheel;

a reference table arranged at a position opposing the displacement-detection means and internally connected to the lower wheel, the reference table providing a displacement-detection reference position;

wherein the at least one workpiece is polished by a relative difference in speeds between the at least one workpiece and at least one of the lower wheel and the upper wheel;

a substantially cylindrical wheel drive shaft coaxially fixed to the lower wheel, the lower wheel having a cylindrical shape;

at least one carrier for holding the at least one workpiece;

a carrier drive shaft, coaxially arranged in the substantially cylindrical wheel drive shaft, for driving the at least one carrier for rotation and revolution around the lower wheel;

a transmission shaft, connected to the carrier drive shaft, for driving the carrier drive shaft; and a connection arm passing through a through-hole formed in the carrier drive shaft, wherein the lower wheel and the reference table are joined together through the connection arm, and the transmission shaft is rotatably mounted on an inner wall of the wheel drive shaft.

2. The polishing apparatus according to claim 1, wherein the transmission shaft is a flexible shaft.

3. The polishing apparatus according to claim 2, wherein the displacement-detection means is of a contact-type comprising a probe which abuts against the reference table.

4. The polishing apparatus according to claim 2, wherein the displacement-detection means is of a non-contact-type comprising a light emitting and receiving unit for emitting light to and receiving light from the reference table, respectively.

5. The polishing apparatus according to claim 1, wherein the displacement-detection means is of a contact-type comprising a probe which abuts against the reference table.

6. The polishing apparatus according to claim 1, wherein the displacement-detection means is of a non-contact-type comprising a light emitting and receiving unit for emitting light to and receiving light from the reference table, respectively.

* * * * *